US006102751A

United States Patent [19]

Becker

[11] Patent Number: 6,102,751

[45] Date of Patent: Aug. 15, 2000

[54] FEMALE SOCKET ASSEMBLY FOR ELECTRICAL CONNECTOR

[75] Inventor: Timothy D. Becker, Cypress, Tex.

[73] Assignee: Houston Geophysical Products, Inc., Houston, Tex.

[21] Appl. No.: 09/035,415

[22] Filed: Mar. 5, 1998

[51] Int. Cl.[7] ..... H01R 13/187

[52] U.S. Cl. ..... 439/843; 439/784

[58] Field of Search ..... 439/843, 784, 439/278, 279, 280, 281, 675, 807, 842, 851, 338, 334, 340, 615, 624, 852; 411/395

[56] References Cited

U.S. PATENT DOCUMENTS

| | | | |
|---|---|---|---|
| 2,225,728 | 12/1940 | Weidenman | 439/278 |
| 2,391,425 | 12/1945 | Korn . | |
| 3,166,371 | 1/1965 | Brown et al. | 439/281 |
| 3,210,720 | 10/1965 | Harris, Jr. | 439/518 |
| 3,457,573 | 7/1969 | Patyna et al. | 411/395 |
| 3,617,990 | 11/1971 | Colardeau | 439/88 |
| 4,431,254 | 2/1984 | Cartesse . | |
| 4,758,175 | 7/1988 | Didier et al. . | |
| 4,797,126 | 1/1989 | Botka . | |
| 5,102,276 | 4/1992 | Gourd | 411/392 |
| 5,120,268 | 6/1992 | Gerrans | 439/736 |
| 5,199,893 | 4/1993 | Fussell | 439/271 |
| 5,417,592 | 5/1995 | West | 439/624 |
| 5,486,124 | 1/1996 | Wandler | 439/843 |
| 5,624,288 | 4/1997 | Becker . | |
| 5,857,879 | 1/1999 | Endo et al. | 439/851 |

*Primary Examiner*—Paula Bradley
*Assistant Examiner*—Ross Gushi
*Attorney, Agent, or Firm*—Browning Bushman

[57] ABSTRACT

A removable socket assembly (36, 44) for an electrical connector (10, 18) in a take-out assembly for a seismic cable (11). The socket assembly (36, 44) has a receptacle (50) receiving a socket (52) in a threaded relation. Base (68) of socket (52) has a bore (82) of a hexagonal cross section and a tool (90) of a hexagonal cross section is received within bore (82) in a mating relation for removal and replacement of socket (52) in the event of malfunctioning.

18 Claims, 2 Drawing Sheets

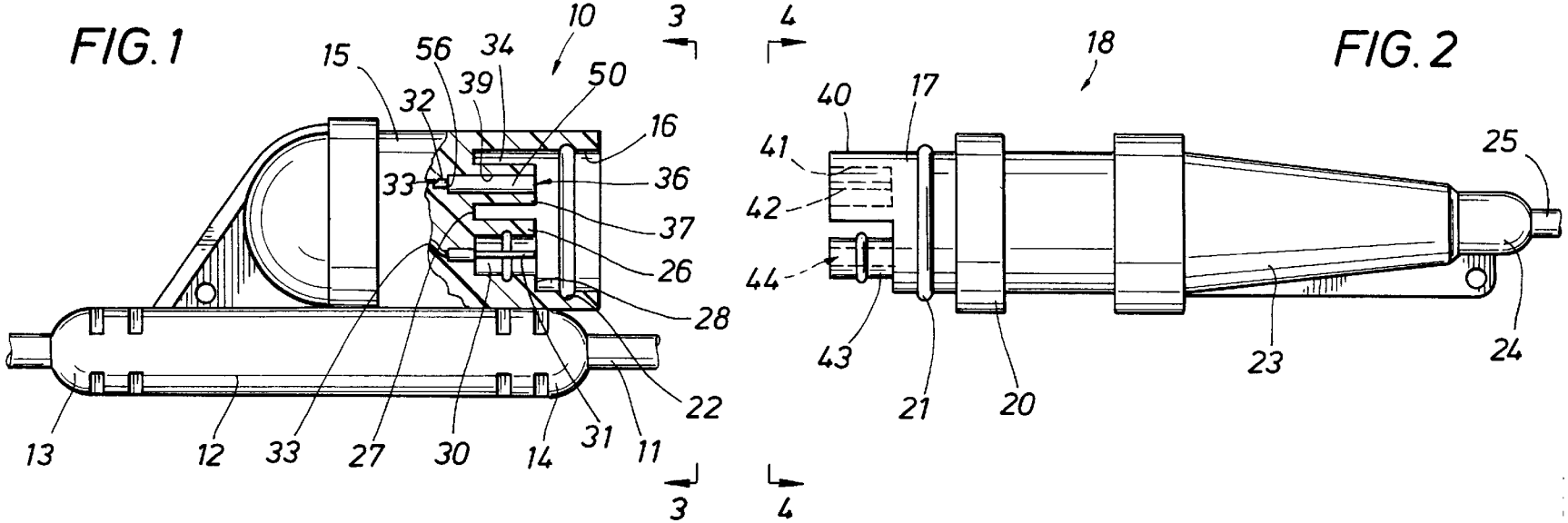
FIG. 2
FIG. 1
10
11
12
13
14
15
16
17
18
20
21
22
23
24
25
26
27
28
30
31
32
33
34
36
37
39
40
41
42
43
44
50
56
3
4
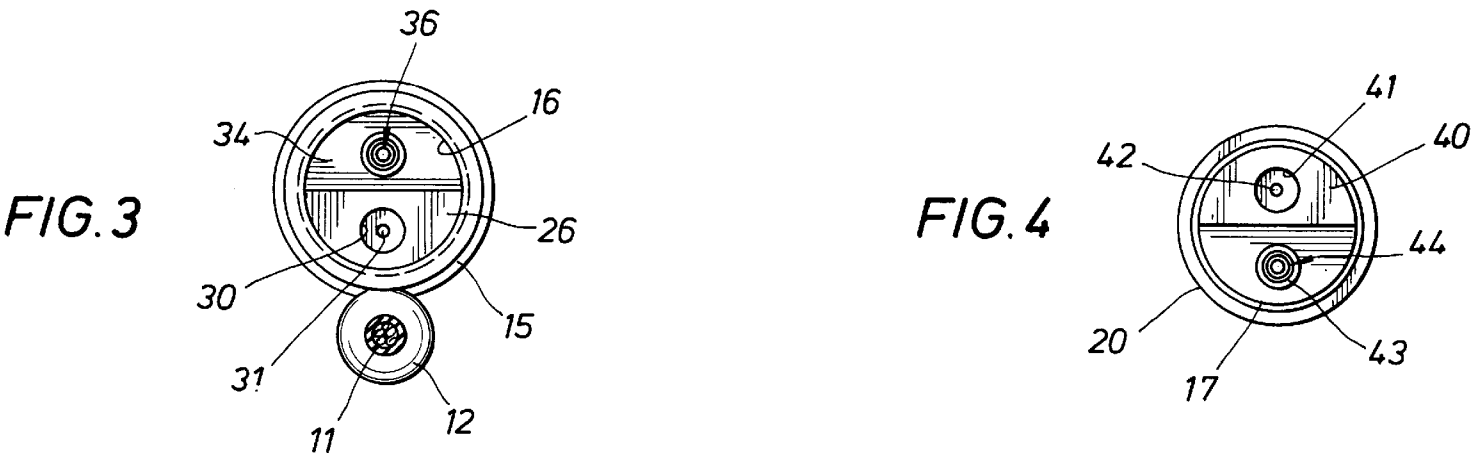
FIG. 4
FIG. 3
11
12
15
16
17
20
26
30
31
34
36
40
41
42
43
44

FEMALE SOCKET ASSEMBLY FOR ELECTRICAL CONNECTOR

FIELD OF THE INVENTION

This invention relates generally to electrical connectors used in seismic surveys, and more particularly to a female socket assembly for an electrical connector which may be easily replaced in the field in the event of failure of the female socket assembly.

BACKGROUND OF THE INVENTION

Heretofore, such as shown in U.S. Pat. No. 5,624,288 dated Apr. 29, 1997, a female socket assembly for an electrical connector has been provided which may be easily replaced. However, a blade screwdriver is used for engaging the socket assembly for removal of a failed socket assembly and for mounting of a replacement socket assembly. The socket assembly shown in U.S. Pat. No. 5,624,288 has diametrically opposed slots in the outer end of a sleeve and the sleeve is force fitted at its opposed inner end into a base of an outer receptacle. The blade screwdriver is received within the slots for rotating the socket assembly. The outer sleeve is twisted and subjected to torsion forces from the screwdriver and sometimes the force fit between the sleeve and base is interrupted particularly upon a strong rotational or torsional force from the screwdriver. It is desirable that a socket for an electrical connector be easily removed and replaced by a tool that minimizes torsional forces exerted by the tool against the socket.

SUMMARY OF THE INVENTION

The improved socket assembly of the present invention for an electrical connector used in seismic surveys includes an elongate outer tubular receptacle receiving an inner socket. The outer receptacle has a cylindrical outer shell and a base with an internally threaded base portion. The socket has an externally threaded base and a plurality of arcuate tines extending from the base. An outer sleeve is force fitted on the base about the tines. A central bore extends through the entire base to define opposed open ends at opposite ends of the base. The central bore of the base has a hexagonal shape or opening formed by planar surfaces and an elongate tool formed of a hexagonal shape fits within the hexagonal opening of the base which extends the entire length of the base thereby to provide a relatively large contact area between the tool and the socket to minimize any stress concentration resulting from the torque exerted by the tool upon removal and replacement of the socket assembly. The torque load from the tool is applied in a direction in transverse alignment with the engaging screw threads of the socket and receptacle thereby minimizing torsion loads applied against the socket assembly from the hexagonal tool. The entire length of the base is engaged by the tool within the hexagonal opening to provide a large contact area.

It is an object of the present invention to provide a socket threaded within a receptacle of a socket assembly for an electrical connector for seismic surveys to minimize torsional loads exerted by a tool against the socket during removal and replacement of the socket.

A further object of the present invention is to provide such a threaded socket that is removed from the receptacle and replaced by an alien type tool insertable within a non-circular opening of the socket for removing the threaded socket from the receptacle and for inserting a replacement socket within the receptacle.

Other objects, features, and advantages of this invention will become more apparent from the following specification and drawings.

BRIEF DESCRIPTION OF THE DRAWINGS

FIG. 1 is a side elevational view with some fragmentary portions in section of a female take-out connector assembly for a geophone string;

FIG. 2 is a view similar to FIG. 1 of the male connector for connecting to the female connector of the connector assembly;

FIG. 3 is an end view along line 3—3 of FIG. 1 showing the pin and socket of the female connector of claim 1;

FIG. 4 is an end view along line 4—4 of FIG. 2 of the pin and socket of the detachable male connector of FIG. 2;

DESCRIPTION OF THE INVENTION

Figure 5:
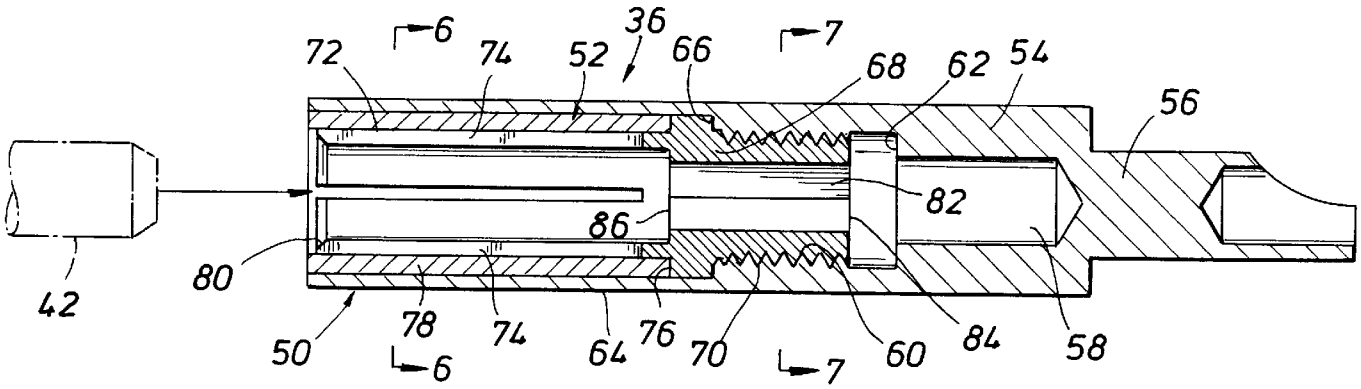
FIG. 5 is a sectional view of the female socket assembly of the present invention removed from the female electrical connector shown in FIG. 1.

FIGS. 1 and 2 show a take-out assembly for a seismic cable in which a female electrical connector is shown at 10 in FIG. 1 and a male electrical connector is shown at 18 in FIG. 2 disconnected from female electrical connector 10. Referring initially to FIG. 1, female electrical connector is molded onto a geophone cable 11 and includes a tubular base 12 having stress relief sections 13, 14 at each end. A generally tubular housing 15 is joined to the base 12 and formed with an outwardly opening recess 16 that is adapted to receive the front portion 17 of companion male connector 18. An outwardly directed annular shoulder 20 on male connector 18 limits movement of the front portion 17 into the recess 16, and a raised annular rib 21 is positioned in an internal groove 22 in the recess 16 to provide a seal that prevents entry of moisture. The rear portion 23 of male connector 18 can be conically tapered as shown and joined to a stress relief portion 24 that surrounds a leader cable 25. Cable 25 extends to a typical geophone (not shown) having a sensor that provides an output signal when an acoustic wave passes it. The sensor usually is mounted on a housing having a spike that extends into the ground so that a number of such geophones can be positioned at spaced locations along a survey line.

As shown in FIGS. 1 and 3, the recess 16 in housing 15 is defined in part by the outer walls of a semi-circular section 26 that extends from the rear wall 27 of the recess to a wall 28 that is located inward of the groove 22. A bore 30 in the center of the section 26 receives a contact pin 31 whose rear portion projects into the section 32 of the body and has a conductor wire 33 electrically connected thereto. The open semi-circular region 34 of the recess 16 has an integral molded sheath 37 projecting outwardly from rear wall 27 of housing 15 and forms an opening 39 therein. Female socket assembly 36 forms an important part of this invention and is received within opening 39 with an end prong 56 in electrical contract with conductor wire 33. As shown in FIGS. 2 and 4, the mating structure of male connector 18 includes a semicircular portion 40 having a bore 41 that receives a pin connector 42 and an outwardly extending sheath 43 that surrounds a female socket assembly 44. Pin connector 42 is received within female socket assembly 36. The bores 30 and 41 and the sheaths 37 and 43 have coacting surfaces that seal the contacts against entry of moisture when the female and male connectors 10 and 18 are made up. For further details, reference is made to U.S. Pat. No. 5,624,288 dated Apr. 29, 1997, the entire disclosure of which is incorporated by this reference.

Figure 7:
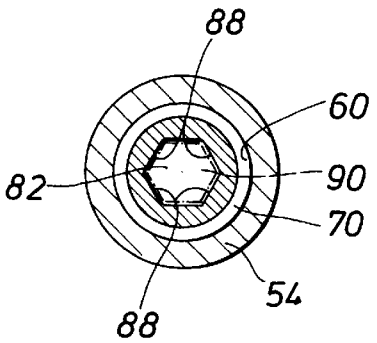
FIG. 7 is a sectional view taken generally along line 7—7 of FIG. 5.
Figure 6:
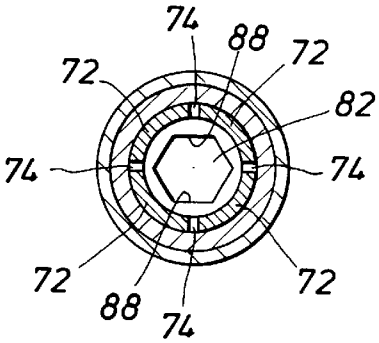
FIG. 6 is a sectional view taken generally along line 6—6 of FIG. 5.
Figure 8:
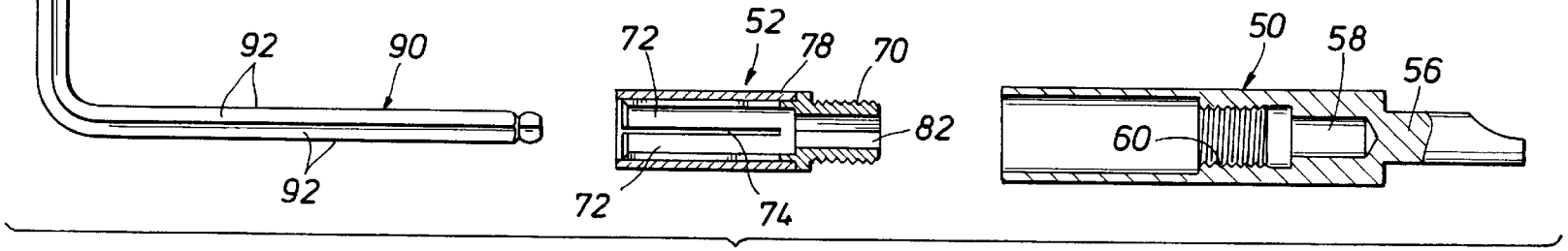
FIG. 8 is an exploded view of the female socket assembly shown in FIG. 5.

Referring to FIGS. 5–8, female socket assembly 36 which comprises the present invention is removably inserted within opening 39 of female connector 10. Socket assembly 36 includes a receptacle generally indicated at 50 and a socket generally indicated at 52 removably threaded within receptacle 50. Receptacle 50 has a base 54 and prong 56 extends therefrom for fitting within opening 39 to provide electrical contact with lead 33. Base 54 has a bore defining a blind smooth end portion 58 and an internally threaded base portion 60. An annular shoulder 62 is defined between bore portions 58 and 60. A cylindrical outer shell 64 extends from base 54 and an annular shoulder 66 is defined between shell 64 and base 54.

Socket 52 has a base 68 with an externally threaded end portion 70. Four arcuate tines or spring fingers 72 separated by longitudinal slots 74 extend outwardly from base 68. An outer annular shoulder 76 is formed on base 68 adjacent fingers 72. An outer cylindrical sleeve 78 is press fitted over fingers 72 and seats against shoulder 76. The outer end of sleeve 78 is tapered at 80. Base 68 has a central bore or opening 82 extending therethrough defining opposed open ends 84 and 86. Bore 82 is defined by six planar surfaces 88 to form bore 82 of a hexagonal shape extending for the entire length of base 68 and in transverse alignment with threaded end portion 70. Pin 42 is adapted to be received snugly within socket 52. Base 68 including fingers 72 are preferably formed of beryllium copper while outer sleeve 78 is preferably formed of nickel plated brass.

An alien type tool or wrench generally indicated at 90 is of a hexagonal shape in cross section defined by planar surfaces 92. Tool 90 for removal and replacement of socket 52 is inserted manually within bore 82 with surfaces 92 in mating contact with surfaces 88. Rotation of tool 90 easily removes socket 52. Since bore 82 is in transverse alignment with threaded end portion 70 any torsional loads exerted by tool 90 are minimized. Also, bore 82 is of a relatively long length to provide a relatively large contact area between tool 90 and base 68 to minimize stress concentrations. Thus, a simplified method for installing socket 52 within receptacle 50 and removing socket 52 from receptacle 50 has been provided. While tool 90 has been shown as an alien tool, it is apparent that other tools may be utilized in a satisfactory manner.

While female socket assembly 36 has been illustrated in the drawings or utilized with female connector 10 it is to be understood that female socket assembly 44 for male connector 18 is similar to female socket assembly 36. Also, while the take-out assembly has been indicated as utilized with geophones, it is to be understood that this invention is applicable to hydrophones and the term "geophone" is interpreted herein as including hydrophones.

Operation

In operation for removal and replacement of a socket 52 from socket assembly 36 or socket assembly 44, male connector 18 is first removed from female connector 10. The socket 52 to be replaced in either male connector 18 or female connector 10 is then exposed for removal by tool 90. Tool 90 is inserted within bore 82 of female connector 10 with the extending end of tool 90 extending within smooth bore portion 58 to insure full contact with the planar surfaces 88 of base 54 defining bore 82. Rotation of tool 90 in one direction effects removal of socket 52 from receptacle 50. A replacement socket 52 may be easily inserted within receptacle 50 and threaded within base 54 upon insertion and rotation of tool 90 in an opposed direction.

While a preferred embodiment of the present invention has been illustrated in detail, it is apparent that modifications and adaptations of the preferred embodiment will occur to those skilled in the art. However, it is to be expressly understood that such modifications and adaptations are within the spirit and scope of the present invention as set forth in the following claims.

What is claimed is:

1. An improved socket assembly for a female electrical connector adapted to receive a pin therein; said socket assembly comprising:

an elongate tubular receptacle having a cylindrical outer shell and a base including an internally threaded bore portion communicating with said shell; and a separate removable socket member positioned within said cylindrical outer shell and having a central bore extending for substantially the entire length of the socket member, said socket member having an externally threaded base threaded within said internally threaded bore of said receptacle for securing said socket member within said cylindrical outer shell of said receptacle, said central bore having an inner end bore portion of reduced diameter extending through said externally threaded base and defining an irregular non-circular opening adapted to receive a tool for rotating and removably mounting said socket member within said internally threaded bore portion of said receptacle.

2. The improved socket assembly as set forth in claim 1 wherein said socket member includes an outer annular shoulder extending about said base and a plurality of arcuate tines arranged in a circle and extending from said shoulder, and an outer cylindrical sleeve seated on said shoulder and receiving said arcuate tines in telescoping relation.

3. The improved socket assembly as set forth in claim 1 wherein said non-circular opening in said base extends through said base and is defined by a plurality of planar surfaces.

4. The improved socket assembly as set forth in claim 1 wherein said non-circular opening in said base is defined by six planar surfaces to provide a hexagonal opening for receiving a tool to rotate said socket member relative to said receptacle.

5. The improved socket assembly as set forth in claim 1 wherein said base has an unthreaded bore portion forming a continuation of said internally threaded bore portion adapted to receive an extending end of said tool for rotative mounting of said socket member within said receptacle.

6. The improved socket assembly as set forth in claim 2 wherein said cylindrical sleeve is formed of nickel plated brass, and said base and integral tines are formed of beryllium copper.

7. In a female electrical connector molded onto a seismic cable, the female connector including a tubular base receiving the cable and a tubular housing molded on the tubular base, the tubular housing having a recess to receive a detachable male connector; an improved socket assembly for each of said connectors comprising:

an elongate tubular receptacle having a cylindrical outer shell and a base including an internally threaded bore portion communicating with said shell; and a separate removable socket member received within said cylindrical outer shell and having a central bore extending for the entire length of the socket member and defining opposed open ends, said socket member having an externally threaded base threaded within said internally threaded bore of said receptacle for securing said socket member within said receptacle, said central bore having a reduced diameter inner end bore portion extending through said base, said inner end bore portion defining an irregular non-circular opening adapted to receive a tool for rotating and removably mounting said socket within said receptacle.

8. The improved socket assembly as set forth in claim 7 wherein said socket member includes an outer annular shoulder extending about said base and a plurality of arcuate tines arranged in a circle and extending from said shoulder, and an outer cylindrical sleeve seated on said shoulder and receiving said arcuate tines in telescoping relation.

9. The improved socket assembly as set forth in claim 7 wherein said non-circular opening in said base is defined by six planar surfaces to provide a hexagonal opening for receiving a tool to rotate said socket relative to said receptacle.

10. The improved socket assembly as set forth in claim 7 wherein said base has an unthreaded bore portion forming a continuation of said internally threaded bore portion adapted to receive an extending end of said tool for rotative mounting of said socket member within said receptacle.

11. The improved socket assembly as set forth in claim 8 wherein said cylindrical sleeve is formed of nickel plated brass, and said base and integral tines are formed of beryllium copper.

12. The improved socket assembly as set forth in claim 7 wherein said receptacle includes an inner annular shoulder defined between said shell and said internally threaded base of said receptacle, said socket member having said inner end bore portion extending therethrough and being threaded within said internally threaded bore portion in abutting contact with said inner annular shoulder.

13. The improved socket assembly as set forth in claim 7 wherein said inner end bore portion has a hexagonal opening adapted to receive a mounting tool having a hexagonal cross section for fitting within said hexagonal opening.

14. An electrical connector take-out assembly for a seismic cable used in seismic exploration comprising:

a female connector having a pin and a socket assembly;

a male connector having a pin and a socket assembly and adapted for detachable connection to said female connector in mating contact with said pin and socket assembly of said female connector, said male connector arranged for connection to a geophone for the collection of seismic data;

each socket assembly including an elongate tubular receptacle having a cylindrical outer shell and a base including an internally threaded bore portion communicating with said shell; and a separate socket member positioned within said cylindrical outer shell and having a central bore extending for substantially the entire length of the socket and defining opposed open ends, said socket member having an externally threaded base threaded within said internally threaded bore of said receptacle for securing said socket member within said receptacle, said central bore having a reduced diameter inner end bore portion extending through said base, said inner end bore portion defining an irregular non-circular opening adapted to receive a tool for rotating and removably mounting said socket member within said receptacle.

15. The electrical connector take-out assembly as set forth in claim 14 wherein said inner end bore portion has a hexagonal opening adapted to receive a mounting tool having a hexagonal cross section for fitting within said hexagonal opening.

16. The electrical connector take-out assembly as set forth in claim 14 wherein said receptacle includes an inner annular shoulder defined between said shell and said internally threaded base of said receptacle, said socket member having said inner end bore portion extending therethrough and being threaded within said internally threaded bore portion in abutting contact with said inner annular shoulder.

17. The electrical connector take-out assembly as set forth in claim 14 wherein said base has an unthreaded bore portion forming a continuation of said internally threaded bore portion adapted to receive an extending end of said tool for rotative mounting of said socket member within said receptacle.

18. The electrical connector take-out assembly as set forth in claim 14 wherein said socket member includes an outer annular shoulder extending about said base and a plurality of arcuate tines arranged in a circle and extending from said shoulder, and an outer cylindrical sleeve seated on said shoulder and receiving said arcuate tines in telescoping relation.

* * * * *